US009228245B1

(12) United States Patent
Elizer

(10) Patent No.: US 9,228,245 B1
(45) Date of Patent: Jan. 5, 2016

(54) PELLETIZED COMPOSITION FOR MOLTEN METAL DE-OXIDATION AND METHOD OF MAKING SAME

(71) Applicant: Mark C. Elizer, Wellington, FL (US)

(72) Inventor: Mark C. Elizer, Wellington, FL (US)

(73) Assignee: Calcium Silicate Corp., Inc., Lake Harbor, FL (US)

( * ) Notice: Subject to any disclaimer, the term of this patent is extended or adjusted under 35 U.S.C. 154(b) by 1 day.

(21) Appl. No.: 14/046,387

(22) Filed: Oct. 4, 2013

Related U.S. Application Data

(60) Provisional application No. 61/886,553, filed on Oct. 3, 2013, provisional application No. 61/709,723, filed on Oct. 4, 2012.

(51) Int. Cl.

| | |
|---|---|
| ***C22B 1/24*** | (2006.01) |
| ***C22B 1/248*** | (2006.01) |
| ***C22B 1/242*** | (2006.01) |
| ***C22B 1/244*** | (2006.01) |

(52) U.S. Cl.
CPC ..... *C22B 1/2406* (2013.01); *C22B 1/242* (2013.01); *C22B 1/244* (2013.01); *C22B 1/248* (2013.01)

(58) Field of Classification Search
CPC ..... C22B 1/2406; C22B 1/242; C22B 1/248; C22B 1/244
See application file for complete search history.

(56) References Cited

U.S. PATENT DOCUMENTS

| | | | | |
|---|---|---|---|---|
| 2,444,424 | A | 7/1948 | Brown et al. | |
| 4,786,438 | A * | 11/1988 | Blackmore | 252/510 |
| 7,744,691 | B2 | 6/2010 | Elizer et al. | |
| 7,883,565 | B2 | 2/2011 | Elizer et al. | |
| 2012/0017725 | A1 * | 1/2012 | Meynerts et al. | 75/303 |

OTHER PUBLICATIONS

Zheng et al. CN 102443674 A published May 9, 2012. Abstract Only.*
Zheng et al. CN 102443674 A published May 9, 2012. Machine translation.*

* cited by examiner

*Primary Examiner* — George Wyszomierski
*Assistant Examiner* — Tima M McGuthry Banks
(74) *Attorney, Agent, or Firm* — GrayRobinson, PA

(57) ABSTRACT

One aspect of the present relates to compositions of a pelletized form which are well suited for use as inoculants in the manufacture or casting of molten metals. A further aspect of the invention relates to a method of making such pelletized compositions from waste materials which bear silicon carbide or both silicon carbide and silicon.

9 Claims, 3 Drawing Sheets

PELLETIZED COMPOSITION FOR MOLTEN METAL DE-OXIDATION AND METHOD OF MAKING SAME

CROSS-REFERENCE TO RELATED APPLICATIONS

This application claims priority under 35 U.S.C. §119(e) to commonly owned U.S. Provisional Application Ser. No. 61/709,723 filed Oct. 4, 2012 for all commonly disclosed subject matter. This application also claims priority under 35 U.S.C. §119(e) to commonly owned U.S. Provisional Application Ser. No. 61/886,533 filed Oct. 3, 2013 for all commonly disclosed subject matter.

STATEMENT REGARDING FEDERALLY SPONSORED-RESEARCH OR DEVELOPMENT

Not Applicable.

INCORPORATION BY REFERENCE

U.S. Provisional Application Ser. No. 61/709,723 is expressly incorporated herein by reference in its entirety to form a part of the present disclosure.

FIELD OF THE INVENTION

This invention relates to the field of metallurgy. More particularly, one aspect of the present relates to compositions of a pelletized form which are well suited for use as inoculants in the manufacture or casting of molten metals. A further aspect of the invention relates to a method of making such pelletized compositions from waste materials which include silicon carbide or both silicon carbide and silicon, either in the presence of substantial amounts of moisture or otherwise. A further aspect of the invention relates to a method of making such pelletized compositions from such waste materials in which polyethylene glycol and/or other organics may be also present in significant amounts.

BACKGROUND OF THE INVENTION

Metals, and in particular iron, steel and other iron alloys of various compositions and grades, are typically prepared by tapping molten material from a continuous melting furnace into a holding ladle from which the molten material may be poured into a mold to form an ingot or other cast product. The melt typically contains impurities detrimental to, or out of specification with, the desired ingot or product. Various deoxidizing compounds may be introduced below the surface of the ladle melt, or into the melting furnace, to control graphite content and remove oxygen and unwanted substances from the melt prior to pouring. De-oxidation refers to the removal of oxides and oxygen from molten metal and involves adding materials with a high affinity for oxygen, the oxides of which are either gaseous or readily form slags. The de-oxidation and desulphurization of steel is usually performed by adding, silicon (Si), aluminum (Al) or manganese (Mn). Common deoxidizing inoculants for such purposes include: ferrosilicon, ferromanganese, and calcium silicide which are sometimes used in the production of carbon steels, stainless steels, and other ferrous alloys; manganese which is often used in steelmaking; silicon carbide and calcium carbide which are commonly used as ladle deoxidizers in steel production; aluminum dross which can be used to deoxidize slag in secondary steelmaking; calcium which can used as a deoxidizer, desulfurizer, or decarbonizer for ferrous and non-ferrous alloys, and titanium which can be used as a deoxidizer for steels.

As reflected by U.S. Pat. No. 2,444,424 to Brown et al., it has been known since about 1945 that granular silicon carbide (SiC), also known as carborundum, may be introduced to the ladle during steel pouring to significantly improve the quality of steel alloys. Silicon carbide must be of sufficiently fine sized particles to be readily dispersed within the steel melt as it enters the ladle in order to completely decompose into silicon and carbon for the deoxidation reactions to occur homogenously. The silicon carbide must be fed into the ladle as steel is entering the ladle at a controlled rate to assure complete sub-surface mixing of the reactants. Silicon carbide (SiC) offers substantial deoxidizing capabilities and exothermic benefits (i.e. thermal gain) to facilitate the controlled de-oxidizing process in steel manufacturing. In such processes, silicon carbide (SiC) decomposes at ladle temperatures in an exothermic reaction, which in addition to yielding substantial amounts of heat also yields silicon (Si) which acts as a reducing agent to strip oxides and carbon from the melt. The stripped carbon readily combines with oxygen to form carbon monoxide (CO) and/or carbon dioxide ($CO_2$) which may escape from the melt as a gas or enhance the formation of graphite beneficial to various grades of steel. Silicon in the form of silicon carbide (SiC) has been demonstrated to provide benefits to high quality steel production which exceed those achievable by the use of elemental silicon (Si) or aluminum (Al). Brown et al. '424 teaches that the addition of silicon carbide in amounts ranging from as low as one point one pounds (1.1 lb.) to about eight pounds (8 lb.) of silicon carbide (SiC) per ton of molten steel provides marked improvements in the physical properties of the resulting steel. According to Brown et al. '424, use of about six (6) pounds of silicon carbide (SiC) per ton of steel is preferred for steels containing under zero point two percent by weight (0.2 wt %) carbon, use of about four (4) pounds of silicon carbide (SiC) per ton of steel is preferred for steels containing from zero point two percent by weight (0.2 wt %) to zero point four percent by weight (0.4 wt %) carbon, and use of about two (2) pounds of silicon carbide (SiC) per ton of steel is preferred for steels containing more than zero point four percent by weight (0.4 wt %) carbon.

Various industrial processes employ silicon carbide as an abrasive for cutting and/or surface finishing of steel, silicon, and various alloys. Examples of such processes include, but are not limited to: attrition grinding of steel bearings, vibratory finishing, polishing or de-burring of metallic parts. Silicon carbide is also included, together with silicon in either crystalline and/or polycrystalline form, in the waste material produced from wire saw slicing and squaring of photo-voltaic grade silicon, slicing, polishing of electronic grade silicon, and the like. These operations produce waste which typically includes fine particles of silicon carbide (SiC), metal alloys, silicon and carrying fluids such as glycol-based organic fluids. Vibratory finishing and polishing operation may also yield silicon carbide (SiC) and metal residue for recovery. The spent silicon carbide and abraded metal cuttings may be flushed to a recovery system for partial recycling and disposal as waste.

The demand for alternative sources of energy has spurred the production and commercialization of photovoltaic arrays for generating electricity from sunlight. Such arrays commonly include wafers of silicon, in either single crystalline form and/or polycrystalline form, the latter commonly referred to as "polysilicon". Such wafers are produced at high cost and through the investment of substantial amounts of thermal energy. However, the useful life of photovoltaic arrays is limited and at the end of their useful life such arrays are typically scrapped and disposed of as waste.

SUMMARY OF THE INVENTION

One aspect of the invention relates to the discovery that waste materials generated by various industrial processes include silicon carbide or both silicon carbide and silicon, either in the presence of substantial amounts of moisture or otherwise, can be used to make novel and non-obvious pelletized compositions which are useful for addition to molten metals as inoculants. The pelletized physical format of these compositions is conducive to ease of handling, storage, transport and effective introduction to molten metal processes. The useful solids included in waste material from industrial processes such as those mentioned above may include not only silicon carbide (SiC) or both silicon carbide (SiC) and elemental silicon (Si) but may also include carbon (C) and/or one or more other metals.

A further aspect of the invention relates to a process for producing such pelletized compositions. According to a preferred embodiment, after at least partial drying and reduction in mesh size, if needed, a waste material mixture containing silicon carbide (SiC), or both silicon carbide (SiC) and silicon (Si), is mechanically and thermally in which the pelletized composition is in the form of pellets having a, preferably with the aid of a sacrificial binding agent, to form a pelletized composition in which individual pellets have not only a controlled chemistry suitable for use as inoculants in molten metals but also have generally spheroidal to slightly ellipsoidal body of controlled size and sufficient mechanical integrity (compressive strength) to facilitate their efficient handling, transportation and storage as well as to permit effective introduction and controlled release to molten metals at a desired stage of production or casting.

DETAILED DESCRIPTION OF PREFERRED EMBODIMENTS

Figure 1:
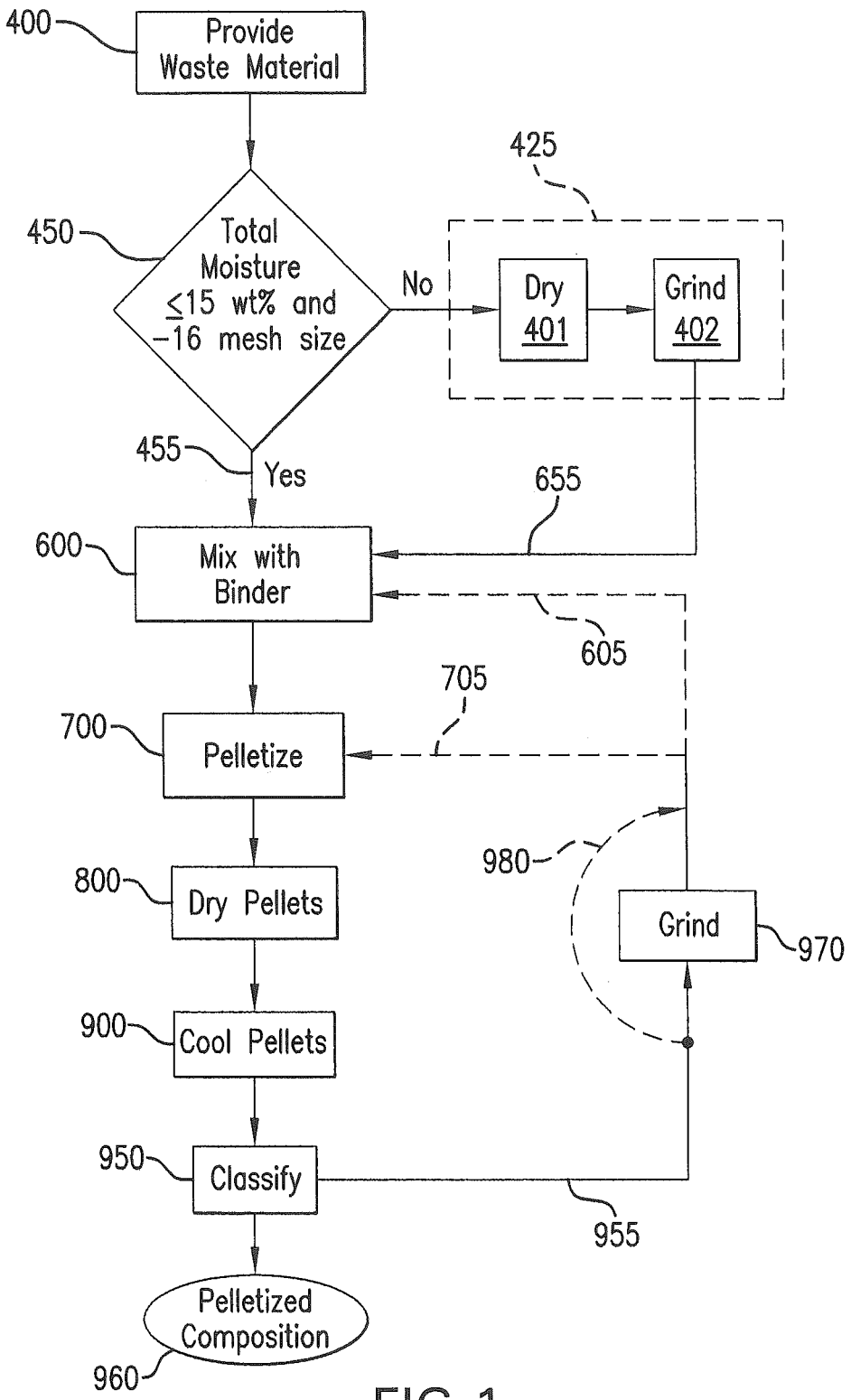
FIG. 1 is a flow chart illustrating the steps of a preferred embodiment of a method for making a pelletized composition according to the invention.

Referring initially to FIG. 1, preferred embodiments of a method for making a pelletized composition according to the invention will now be described. In a step 400, at least one waste material containing substantial amounts of metallurgically-available silicon, in the form of silicon carbide (SiC) or both silicon carbide (SiC) and silicon (Si) is provided. Such material may be for example, of a type recovered from one of the industrial processes noted above and/or from silicon wafers from de-commissioned photo-voltaic arrays. In preferred embodiments, the solids contained in the raw waste material may suitably comprise (by weight percentage of total solids) any combination or subcombination of the following which totals one hundred percent by weight (100 wt %):

SiC 20 wt % to 80 wt %
Si 0 wt % to 50 wt %
C<5 wt %
Fe<10 wt %
other impurities <1 wt %.

As recovered from industrial processes, such waste materials may often significant amounts of moisture. As represented at 450, if the waste material is too wet and/or is of an unsuitably large mesh size, it is subjected to a preprocessing step 425. Pre-processing step 425 preferably includes the substep 401 of at least partially drying the material and the substep 402 of reducing the mesh size of the material. In a preferred embodiment, substep 401 comprises reducing the total moisture content of the material to less than or equal to fifteen percent by weight (15 wt %). In this context, "total moisture content" is intended to include any and all liquids, including but not limited to water and/or organic fluids. In a preferred embodiment, substep 402 comprises reducing the mesh size of the material to minus 16 mesh. Substep 402 preferably follows substep 401 although carrying out those substeps in such order is not essential to the invention and FIG. 1 is not to be construed as requiring the drying substep 401 to be executed prior to the mesh size reduction substep 402. In certain embodiments, substep 402 may permissibly be carried out prior to substep 401. In certain other embodiments, substeps 401 and 402 may even be carried out so as to partially or completely overlap in time. By way of non-limiting examples, one suitable way for carrying out all or part of substep 402 is by grinding the waste material. Alternatively, the material could be passed through one or more screens of suitable mesh size with material of suitably small mesh size being selected for further processing.

Once the material being processed is available in a form which is suitably dry and is of suitably small mesh size, preferably containing total moisture of less than or equal to fifteen percent by weight (15 wt %) and preferably sized at minus 16 mesh, as indicated at reference numerals 455 and/or 655 in FIG. 1, the material being processed may be mixed thoroughly with any suitable binder as indicated by step 600. As indicated by broken line arrow 605, step 600 may optionally include the addition into the mixture of recycled pellet material, after such material has been suitably reduced in size if necessary. The recycled material optionally introduced as indicated at 605 may comprise, or consist substantially entirely of, oversized and/or undersized pellets rejected from screen sizing steps to be described below and/or of dust from such pellet material recovered from a dust collection system, such as the optional cyclonic dust collection system 300 mentioned further below. The binder preferably comprises an organic/mineral binder such as, but not limited to, a thermoset binder such as calcium lignosulphonate ($C_{20}H_{24}CaO_{10}S_2$). Such a binder lends a certain degree of tackiness which aids in the formation of pellets but does not harden until sufficient heat is later applied. Also, such binder will readily dissolve and be vaporized at molten metal ladle temperature, largely leaving behind only metallurgically beneficial or innocuous substances such as carbon, thereby allowing the pellets to disintegrate in the ladle when in use and disperse their remaining finely divided solids into the molten metal without adding significant amounts of metallurgically undesirable chemical constituents to the metal. As an option, step 600 may include the substep of adding one or more additives to the material being processed. Such additive(s) may comprise, or consist of, any material desired for contributing to the desired properties of either the pellets being produced or the metal to be made with use of the pellets. By way of non-limiting examples, additive(s) may comprise, or consist substantially of, iron fines, the addition of which will tend to make the resulting pellets harder and more durable. Additives may also consist substantially of, or include, any combination or sub-combination of: (i) silicon, such as ground wafers of silicon recovered from scrapped or de-commissioned photovoltaic arrays in the form of single crystalline and/or polycrystalline silicon (ii) de-oxidizers such as silicon carbide, calcium carbide, calcium silicide, ferrosilicon, ferromanganese, aluminum, and/or calcium, and/or (iii) one or more metals as may be desired as alloying agents for use in making a particular alloy.

After mixing with at least an initial amount of binder in step 700, a pelletizing step 700 is carried out on the mixture. Pelletizing step 700 may suitably be carried out by processing the mixture in a pelletizing disc until pellets of a desired size are formed therein. Pelletizing step 700 may optionally but preferably include the substep of adding additional binder to the mix. As indicated by broken line arrow 705, pelletizing step 700 may also optionally include the addition of recycled pellet material into the mixture, after such recycled material has been suitably reduced in size if necessary, preferably to about minus sixteen (−16) mesh or finer. Such recycled material may comprise, or consist substantially entirely of, material from oversized and/or undersized pellets rejected from subsequent screen sizing steps to be described and/or of pellet dust recovered from a dust collection system, such as the optional cyclonic dust collection system 300 mentioned further below. If recycled pellet material is added to the mixture in pelletizing step 700, such optional addition may be carried out in addition to, or in lieu of, the addition of such recycled material in step 600 as indicated by broken line arrow 605.

After pellets of a desired range of sizes have been formed by pelletizing step 700, those pellets are dried, preferably in the presence of heat, in a drying step 800. If a thermoset binder is used, step 700 should be carried out for a time and at a temperature sufficient to permit the binder to at least partially harden, and preferably to substantially fully harden, and to drive off substantially all free liquids from the pellets. In a preferred embodiment, step 800 may be carried out according to time and temperature parameters sufficient to reduce the total moisture content of the pellets to less than or equal to about two percent by weight (2 wt %).

After at least substantial completion drying step 800, the pellets may be cooled in a cooling step 900. Cooling step is preferably carried out so as to reduce the temperature of the pellets as quickly as practicable to a temperature which is sufficiently low that ambient air in the vicinity of the pellets will not be heated to a point that it is likely to give up significant moisture that could be absorbed by the pellets and thereby compromise their mechanical integrity. It will be appreciated that a portion of the drying step 900 may be carried out concurrently with the cooling step as the pellets may continue to give up at least some moisture as their temperature decreases. In some preferred embodiments, cooling step 900 is carried out in such a way as to reduce the temperature of the pellets to about one hundred degrees Fahrenheit (100° F.) or less. In certain embodiments, cooling step 900 comprises the step of subjecting the pellets to a forced air flow. Cooling step 900 may also be an aid to the further hardening of the binder material.

In a step 950 pellets are classified according to their size. In preferred embodiments, step 950 may comprise the step of screening the pellets according to their mesh size. In certain preferred embodiments, pellets may be screened to form a finished pelletized composition 960 which does not include a significant percentage of pellets which are outside a range of mesh sizes ranging from about minus one half inch (−½ inch) to about 7 mesh. Preferably, finished pelletized composition 960 consists substantially entirely of pellets ranging in mesh size from minus one half inch (−½ inch) to 7 mesh. In certain preferred embodiments, pellets are screened, sorted, or otherwise classified, in step 950 to form a finished pelletized composition 960 comprised of pellets ranging in mesh size from minus seven (−7) mesh by thirty six (36) mesh. In certain preferred embodiments, the pellets are screened, sorted or otherwise classified in step 950 to form a finished pelletized composition 960 comprised of pellets of one or more gradations. In certain embodiments, a first gradation may consist substantially of pellets ranging in mesh size from minus one half inch (−½ inch) to seven (7) mesh and a second gradation may consist substantially of pellets ranging in mesh size from minus seven (−7) mesh by thirty six (36) mesh. As indicated by arrow 955 in FIG. 1, step 950 may optionally include, or be followed by, the optional recycling of oversized and/or undersized pellets. In the case of oversized pellets, a reduction in mesh size 970 is carried out before returning the material for processing according to step 600 and/or step 700 as described above. As indicated by broken arrow 980, step 970 is not necessary to carry out such recycling if only undersized pellets and/or pellet dust is recycled.

Figure 2:
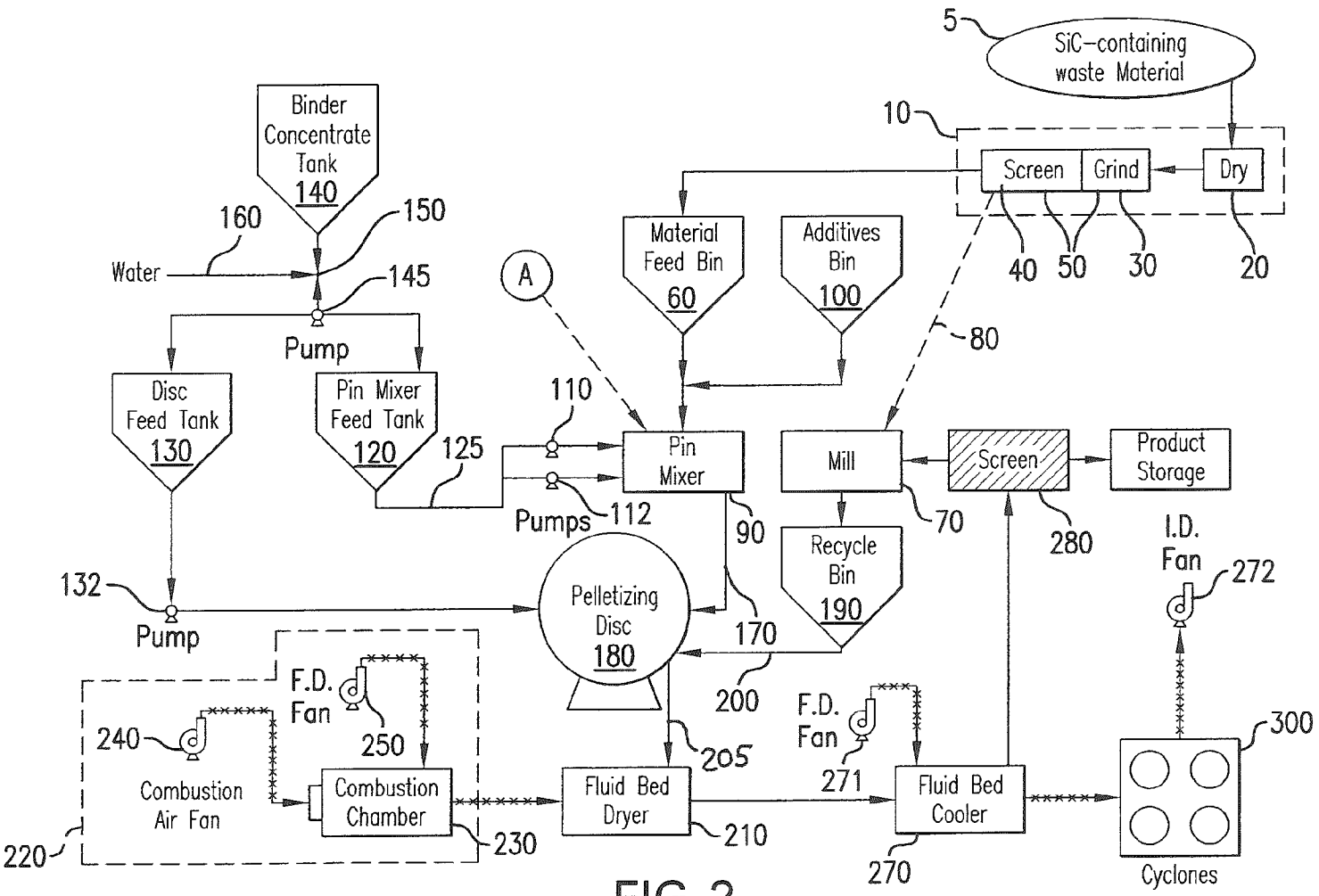
FIG. 2 is a schematic diagram illustrating a plant suitable for making a pelletized composition according to the invention.

FIG. 2 illustrates an example of a plant suitable for carrying out the method of FIG. 1 on a commercial scale. At least one waste material 5 of a type described above which contains substantial amounts of metallurgically-available silicon may be provided as a starting material in its raw form as recovered from one of the industrial processes noted above. Such material 5 will typically contain silicon carbide, or both silicon carbide and silicon, preferably, but not necessarily in the form of very finely divided particles of a nominal size of minus four hundred (−400) mesh. The raw waste material 5 may also include fluids such as water and/or carrying fluids such as polyethylene glycol and/or other organic fluids. The consistency of the raw waste material 5 will vary depending on how much fluid, if any, is initially present and may range by way of non-limiting example from that of an at least moderately dry particulate; to that of a wet or most dough, either relatively uniform or with lumps of varying sizes; to that of a smooth or lumpy slurry, either with or without the presence excess fluid standing above the solids when the material 5 is quiescent. As noted above, in preferred embodiments, the solids contained in the raw waste material 5 include silicon carbide or both silicon carbide and silicon and may suitably comprise (by weight percentage of total solids) any combination or sub-combination of the following which totals 100 wt %:

SiC 20 wt % to 80 wt %
Si 0 wt % to 50 wt %
C<5 wt %
Fe<10 wt %
other impurities <1 wt %.

A waste material 5 may suitably be provided having a total liquid content of fifteen percent by weight (15 wt %) or less and a screen size of sixteen minus (−16) mesh. However, in a raw form as recovered from one of the industrial processes noted above, raw waste material 5 may in some cases have a lumpy consistency and/or have a total liquid content in excess of fifteen percent by weight (15 wt %). In other cases waste material 5 may have a total liquid content in excess of twenty five percent by weight (25 wt %). Raw waste material 5 having a total moisture content in excess of fifteen percent by weight (15 wt %) may undergo pre-processing 10 by way of at least partial moisture reduction, for example using a dryer 20. In cases where the raw waste material 5 exceeds a screen size of about minus 16 mesh, drying is preferably followed by, and/or is accompanied by, mesh size reduction, such as by grinding 30 and/or screening 40, prior to further processing. Preliminary drying 20 of the waste material 5 may suitably accomplished using any known method(s) for reducing the liquid content of bulk materials. Such methods include without limitation centrifuging, heating in a furnace and/or forced air drying. Preferably however, preliminary drying 20 of the raw waste material 5 is carried out, or is at least initiated, in a more energy efficient manner, by drying piles of the material passively in open air, allowing liquids to drain off under gravity and vaporize at ambient temperatures. Such passive drying may optionally be aided by occasionally turning over the material one or more times with the aid of a skid loader (not shown). Drying may also be aided by the addition of dry material of like or similar solids composition, preferably one containing total moisture of less than or equal to five percent by weight (5 wt %). Regardless of the method used, drying 20 is carried out until the then remaining total moisture content of the material does not exceed fifteen percent by weight (15 wt %). If not by then already sufficiently de-lumped as a result of prior handling to allow its passage through a sixteen (16) mesh size screen, the material at total moisture content of fifteen percent by weight (15 wt %) or less, may be fed, either continuously or in one or more batches, into a mill such as a front loading vibratory mill 50 which contains a built-in screen 40 which is preferably sized at sixteen (16) mesh. As indicated by arrow 57, the material nixed at minus sixteen (−16) mesh may then be transferred to a material feed bin 60 while the oversized material being processed which does not pass through screen 40 may optionally but preferably be fed to a grinding mill 70 for further size reduction as indicated in FIG. 2 by broken arrow 80.

The minus sixteen (−16) mesh sized material being processed may be continuously fed from the feed bin 60 into a pin mixer 90 at a rate of five (5) tons per hour. While material feed bin 60 could optionally be eliminated if adequate quantities of suitably dried and suitably sized material is available to be fed directly into pin mixer 90, the inclusion of a material feed bin 60 facilitates process control and allows pin mixer 90 to be fed even at times when sufficient quantities of material might not otherwise be available directly from any pre-processing operation 10. As represented schematically in FIG. 2 by an additives bin 100, one or more additives may optionally be added into the material being processed. Such addition may be made either in the pin mixer 90 or at any prior point of processing. Such additives may comprise, or may consist of, any material desired for contributing to the desired properties of either the pellets being produced or the metal to be made with use of the pellets. By way of non-limiting examples, additive(s) may consist substantially of, or include, iron fines, the addition of which will tend to make the resulting pellets harder and more durable. Additives may also consist substantially of or include any combination or subcombination of: (i) silicon, (ii) de-oxidizers such as silicon carbide, calcium carbide, calcium silicide, ferrosilicon, ferromanganese, aluminum and/or calcium and/or (iii) one or more metals as may be desired to make a particular alloy. The total moisture content of the material being processed, inclusive of any and all recycled pellet material and/or additives used, if any, is preferably about five to fifteen percent by weight (5 wt % to 15 wt %) just prior to entering pin mixer 90.

In the pin mixer 90, a binder is added and is incorporated uniformly into the material by thorough mechanical mixing. The concentration and amount of binder added are selected to be sufficient to facilitate the formation of pellets as processing proceeds in the manner described further below. The binder preferably comprises an organic/mineral binder such as, but not limited to, a thermoset binder such as calcium lignosulphonate ($C_{20}H_{24}CaO_{10}S_2$).

In a preferred embodiment, adding a twenty five percent by weight (25 wt %) solids solution of calcium lignosulphonate ($C_{20}H_{24}CaO_{10}S_2$) in an amount sufficient to constitute two to three percent by weight (2 wt % to 3 wt %) of the overall mixture present in the pin mixer 90 after such addition has been found to be suitable. The binder in liquid form may suitably be sprayed onto the material being processed in the pin mixer 90 by one or more spray nozzles (not shown) mounted to spray the binder directly into the pin mixer 90. Such spraying facilitates more rapid and uniform incorporation of the binder into the material than would adding the binder in less gradual and divided manner. The binder may be pumped to the spray nozzles by way of one or more pumps 110, 112, to which the binder may be fed from a feed tank 120 by way of a line 125. As shown in FIG. 2, feed tank 120, as well as a second feed tank 130, may be replenished with binder supplied from a binder concentrate tank 140 which may be coupled to feed tanks 120 and 130 by way of a pump 145. In some embodiments, the binder concentrate tank 140 may suitably contain a solution of about fifty percent by weight (50 wt %) of calcium lignosulphonate which may be diluted with water to provide a solution of about twenty five percent by weight (25 wt %) solids of calcium lignosulphonate in feed tanks 120 and 130. As shown in FIG. 2 water, or other diluent appropriate for whatever particular binder may be selected, may suitably be added by way of a 3-way mixing valve 150 positioned in line between binder concentrate tank 140 and pump 145, with the 3-way mixing valve 150 further being coupled to a water supply line 160.

In some embodiments an about twenty five percent by weight (25 wt %) solids solution of calcium lignosulphonate from feed tank 120 may be introduced into pin mixer 90 by way of one or more pumps 110, 112 in such amount and concentration that the solids of the calcium lignosulphonate introduced into the pin mixer 90 come to constitute approximately two percent by weight (2 wt %) of the overall mixture present in the pin mixer 90 after the calcium lignosulphonate has been added. The pin mixer 90 is operated to thoroughly and uniformly incorporate the calcium lignosulphonate into the mixture. As indicated by arrow 170, the resulting mixture of material is discharged from the pin mixer 90 and is loaded into a pelletizing disc 180.

In pelletizing disc 180, an additional two percent (2 wt %) solids of calcium lignosulphonate or other suitable binder pumped from feed tank 130 by way of a pump 132 may be added via spray nozzles (not shown) so that the resulting mixture of material present in pelletizing disc 180 after the additional binder has been added comes to include about four percent by weight (4 wt %) calcium lignosulphonate solids. If desired, relatively dry recycled material from a recycle bin 190 may optionally be added into the pelletizing disc 180 as indicated by arrow 200 for inclusion in the mixture. Regardless of whether or not any recycled material is added in the pelletizing disc 180, the pelletizing disc 180 operates on the mixture to form it into pellets of an appropriate size or range of sizes. In a preferred embodiment, such a range would preferably comprise pellets ranging in size from somewhat larger than minus one half inch (−½ in.) mesh to ones somewhat smaller than thirty six mesh. Preferably, pelletization proceeds until most of the material present in pelletizing disc 180 is in the form of moist, generally spheroidal or slightly ellipsoidal shaped, pellets mesh sized minus five eighths of an inch by forty mesh (−⅝ in. by 40 Mesh). The moist pellets may be continuously discharged from the pelletizing disc 180. The pellets are then dried in any suitable manner but are preferably dried with the application of heat to allow drying to be carried out more rapidly. For this purpose, as indicated by arrow 205, the pellets discharged from pelletizing disc 180 may suitably be introduced into a dryer 210, such as a fluidized bed dryer as a non-limiting example, where heat generated by any suitable means may be applied to the pellets. A combustion system 220 has been found to be suitable for generating such heat. As indicated in FIG. 2 a combustion system 220 in a preferred embodiment may suitably include a combustion chamber 230 in which fuel oil, natural gas or other suitable fuel is burned with the aid of air provided by a combustion fan 240. A forced draft fan 250 is also provided for providing air flow to fluidize the bed of material being dried in dryer 210.

In some embodiments, inlet air temperature of the dryer 210 may be about five hundred degrees Fahrenheit (500° F.). Dryer 210 sufficiently heats the pellets to allow the thermoset binder to set. Such heating also drives off any remaining excess moisture by volatilization such that the total moisture content of the pellets is reduced to two percent by weight (2 wt %) or less upon exit from the dryer 210. As indicated by arrow 260, the pellets may be transferred from dryer 210 into a fluidized bed cooler 270 where they are cooled prior to being screened using dual vibratory screens 280 in order to sort the pellets according to their size if desired.

Dust generated during the cooling of the pellets is preferably captured by a cyclonic filtration system 300 coupled to cooler 270. Fluidization of the pellets in the fluidized bed cooler 270 is facilitated by a forced draft fan which forces air into cooler 270 and an induced draft fan 272 which draws exhaust air from cooler 270 by way of filtration system 300. The dust collected by cyclonic filtration system 300 may optionally be deposited in recycle bin for recycling by reintroducing them into either the pin mixer 90, the pelletizing disc 90, or both.

The pellets of the pelletized composition produced in the manner just described are preferably of a mesh size within a range from minus one half inch to thirty-six mesh (−½"×36 mesh). All oversized and undersized pellets rejected by screens 280 may optionally be recycled back to the process cyclonic filtration system 300 with at least the oversized material first being crushed to minus sixteen mesh (−16 mesh) in vibratory mill 70. If desired, the pelletized composition can be further classified according to size by additional screening into separate gradations such as minus one half inch by seven mesh (−½"×7 Mesh) and/or minus seven mesh by thirty-six mesh (−7 Mesh×36 Mesh). The finished pelletized compositions of either gradation can be readily stored and transported either in bulk, in bags, in so-called "super sacks" or in any other suitable container.

In some cases waste material whose solids are of a composition as described above will have moisture content which includes polyethylene glycol and/or other organics and may also include, but does not necessarily include, water. For reference purposes, such a waste materials is designated in FIG. 3 as a waste material 5'. After preferably removing any free standing liquid therefrom in any suitable manner, including without limitation by draining under gravity and/or by centrifuging, waste material 5' is preferably processed in a manner which will now be described with reference to FIG. 3.

As indicated by arrow 500, waste material 5' is dumped, fed or otherwise loaded into the main chamber of an extruder 507. Extruder 507 exerts pressure on the material 5' and forcibly compresses the material 5' into a semi-solid, soft mass 509 through the action of an internal ram 511 which is driven by a hydraulic cylinder 510. In the course of such compression, some liquid may be squeezed from the material in which case such liquid may be drained off into a tank (not shown) for storage pending proper disposal, recycling or other processing.

In some embodiments, extruder 507 may suitably take the form of a nominal two cubic yard capacity compactor such as a model S-200 available from Baker Waste Engineering of Valdese, N.C., fitted at its output end with a compression zone 512 having an internal passage which gradually decreases in cross section. In some embodiments, the internal passage through compression zone 512 may decrease linearly in cross section from a maximum of about forty inches by twenty seven inches (40 in.×27 in.) to about twenty eight inches by eight inches (28 in.×8 in.) over a distance of about forty eight inches (48 in.) as measured in the direction of travel of the ram 511. The ram 511 of extruder 507 is driven with sufficient force to develop a nominal ram pressure of about thirty five hundred pounds per square inch (3,500 p.s.i.). As its ram 511 is driven in a forward direction, extruder 507 forces the material being processed through the internal passage of compression zone 512 such that a portion of the material exits extruder 507 in the form of a semi-solid, soft extruded mass 509 which is preferably, but not necessarily, of uniform cross sectional shape and dimension. Though the size and shape of the extruded mass 509 are not critical, in some embodiments the extruded mass 509 may be in the form of a sheet of rectangular cross section which can for example be twenty eight inches by eight inches wide by eight inches thick (28 in.×8 in.). The dimensional characteristics of the extruded mass 509 of material discharged from compression zone 512 of extruder 507 are preferably such that the material being processed can be fed directly from compression zone 512 into a dryer 520 without need of intervening processing to effect change of shape or dimension.

Extruder 507 and compression zone 512 are configured such that at the maximum extent of the forward stoke of the ram 511 of extruder 507, the front face of the ram 511 stops sufficiently short of the discharge end of compression zone 512 to permit a plug 513 of as-yet-undischarged material being processed to remain within at least a portion of the compression zone, and/or within a portion of extruder 507 itself, at all times during normal operation. This plug 513 of material should be of sufficient mechanical integrity and impermeability to air as to permit a partial vacuum to be maintained in a vacuum region 515. The presence of such a plug 513 of the material being processed assures that a good vacuum seal within vacuum region 515 can be maintained at all times, even when the ram of extruder 507 is retracted to enable the extruder 507 to be re-loaded with material being processed.

In some embodiments, extruder 507 and compression zone 512 are configured such that at the maximum extent of the forward stoke of the ram of extruder 507, the forward face of the ram does not enter the compression zone 512 to any significant extent. In some embodiments, the forward face of ram 511 may permissibly stop at a location within extruder 507 itself so that the plug 513 of as-yet-undischarged material being processed occupies substantially all of the internal volume of the compression zone 512 and may permissibly also occupy a portion of extruder 507.

Figure 3:
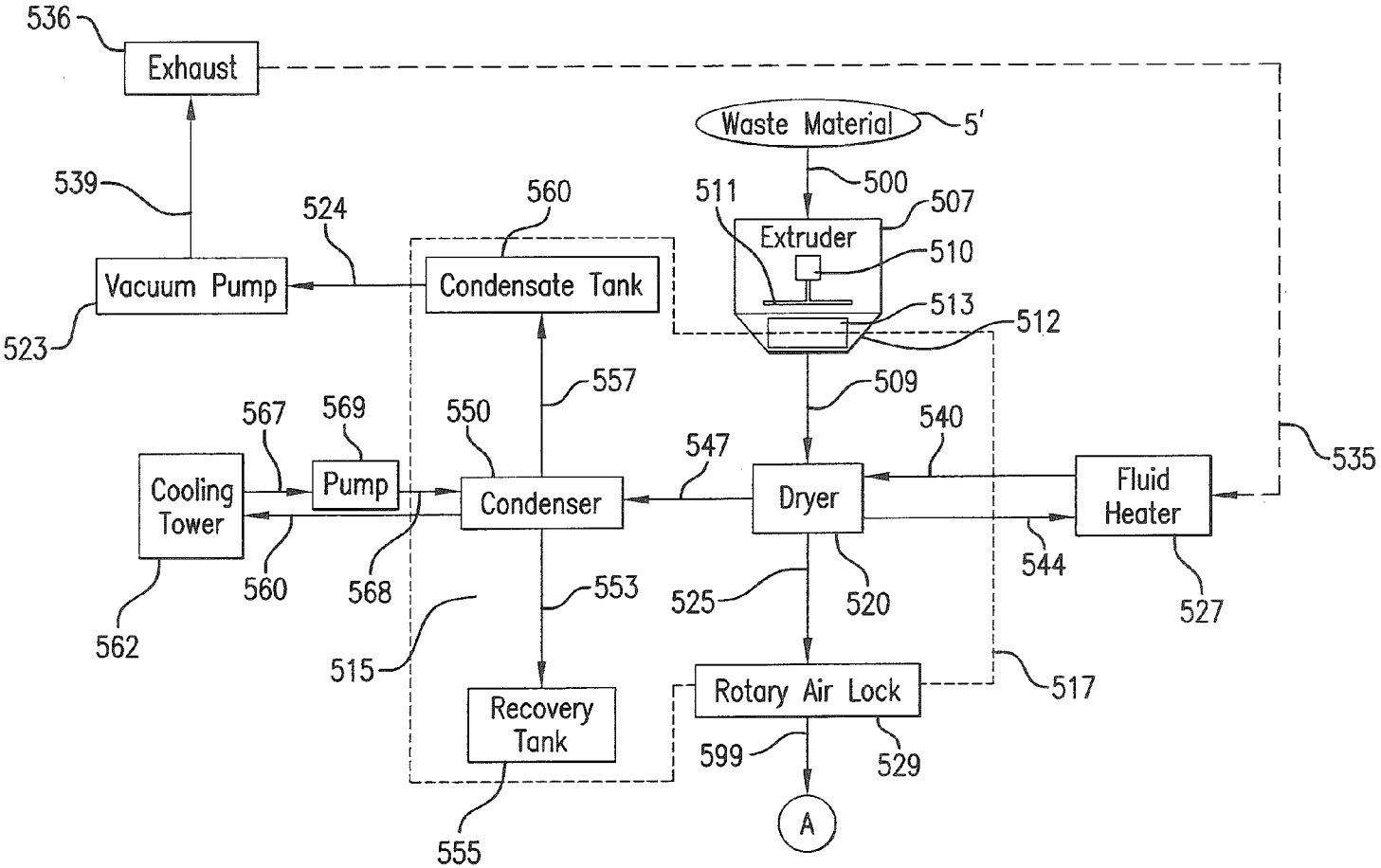
FIG. 3 is a schematic diagram illustrating an alternative form of a plant suitable for making a pelletized composition according to the invention.

As schematically indicated by a broken boundary line 517 in FIG. 3, vacuum region 515 encompasses, among other things, any space which may be present between discharge end of the compression zone 512 and the entry of dryer 520. Vacuum region 515 also encompasses at least all portions of dryer 520 through which the material being processed passes and may permissibly encompass the entire dryer 520. The partial vacuum inside the vacuum region 515 is created and maintained by a vacuum pump 523 which is coupled to vacuum region 515 by way of a flow path 524. In certain embodiments, the vacuum applied to vacuum region 515 by vacuum pump 523 is sufficient to maintain a vacuum of between about eight (8) inches of water column and twenty (20) inches of water column within the portion of dryer 520 through which the material being processed passes. The plug 513 of as-yet-undischarged material being processed which remains in at least a portion the compression zone 512 and/or in at least a portion of extruder 507 serves as a seal which prevents loss of vacuum within vacuum region 515 which could otherwise occur as a result of air leakage by way of compression zone 512 and/or extruder 507.

As the ram 511 of extruder 507 is driven forward, the plug 513 of material previously present in the compression zone 512 is displaced from the compression zone 512 in order to be fed into dryer 520 and is replaced with another plug 513 of the material being processed. When the ram of extruder 507 completes its forward travel, the ram 511 may be retracted so that extruder 507 can be loaded with additional waste material 5' after which the ram 511 of extruder 507 may be driven forward for its next stoke. The plug 513 of material being processed is adequate to maintain a vacuum seal and is present within at least a portion of the compression zone 512 and/or extruder 507 at all times during normal production of pelletized composition 960.

The rate at which material being processed is discharged from compression zone 512 and transferred from compression zone 512 to dryer 520 can be readily controlled by controlling the rate of travel of the ram 511 of extruder 520. Preferably, the rate at which the extruded mass 509 of material being processed is discharged from compression zone 512 is controlled to be at least substantially equal to the rate at which the material being processed can be taken into dryer 520.

While other types of dryers may suitably be used, including without limitation, electrically heated dryers, in certain preferred embodiments, dryer 520 may suitably be a twin auger, screw conveyor dryer of a type whose augers have internal cavities through which a heat transfer fluid may be circulated in order to heat the material being processed as the material is conveyed through the dryer by rotation of the augers. By way of non-limiting example, the latter type of dryer 520 may suitably be a commercially available type such as a model 18-20-6/XNC manufactured by Christian Engineering of under the trademark Holoflite™. In embodiments in which such a dryer 520 is selected to be of such a type, a heat transfer fluid may be heated by a fluid heater 527 and circulated between heater 527 and the interiors of each of the augers in the dryer 520 by way of flow paths 540 and 544 to heat the walls of the augers. By way of non-limiting examples, the heat transfer fluid may suitably take the form of oil or other heated fluid in some embodiments. In some embodiments, the heat transfer fluid may suitably take the form of steam. The augers of heater 520 are rotatably driven to cause the material being processed to move though the dryer 520 in thermal contact with its heated augers. Regardless of the particular type of dryer 520 selected, dryer 520 is operated so that the material being processed is heated according to a time and temperature profile which is suitable to significantly accelerate vaporization of moisture present in the material being processed, without reaching or exceeding the decomposition temperature of any organics which may be present in significant amount in the total moisture content of the material being processed. As noted above, depending on the makeup of the waste material 5', such moisture content may include without limitation water and/or organics such as, but not limited to, polyethylene glycol, which is commonly used as a carrier or cutting fluid for various industrial processes. Such moisture content in some cases may also include or consist of one or more lubricants.

The vacuum present within the portion of dryer 520 through which the material being processed passes serves, in part, to lower boiling point of the constituents of its moisture content to permit them to be removed from the material being processed by boiling them at a temperature which is lower than would be possible at atmospheric pressure and is below the decomposition temperature of any organics included in the moisture content of the material being processed. In some embodiments, the temperature of the material being processed within dryer 520 is set, and/or is controlled, not to exceed two hundred forty degrees Celsius when the vacuum present in dryer 520 is within the range of eight to twenty inches of water column (<240° C. @ 8-20" w.c. vacuum). In embodiments in which dryer 520 is a hollow auger screw conveyor type dryer, the applied vacuum, the temperature of the heat transfer fluid circulated through the augers of the dryer 520, and the rotational speed of the augers may be set, and/or controlled, so as to heat the material being processed according to a time and temperature profile suitable to vaporize moisture present in the material being processed, including without limitation moisture comprised of water and/or organics such as, but not limited to, polyethylene glycol, without subjecting the material being processed to a temperature which reaches or exceeds the decomposition temperature of any organics present in the moisture content of the material being processed.

In certain preferred embodiments, the applied vacuum and time and temperature profile to which the material passing through dryer 520 is subjected are set, and/or are controlled, so as to reduce the total moisture content of the material being processed such that upon discharge from dryer 520 the material being processed has a total moisture content not significantly in excess of fifteen percent by weight (15 wt %) and is preferably less than or equal to fifteen percent by weight (≤15 wt %).

In the event the total moisture content of the material being processed is significantly in excess of fifteen percent by weight (15 wt %) upon discharge from dryer 520, the total moisture content of the material being processed may optionally be further reduced by the addition thereto of dry material of a solids composition which may be the same as, or similar to, that of the material as discharged from dryer 520, or is at least suitable to achieve the desired composition of the finished pellets to be produced. Preferably, any such dry material which may be so added after the material is discharged from dryer 520 has total moisture of less than or equal to five percent by weight (≤5 wt %).

As indicated by the corresponding circles which are labeled for reference with the letter "A" and which appear in FIG. 2 and FIG. 3, after exiting dryer 520 the material being processed may suitably be transferred to the pin mixer 90 of FIG. 2 to complete the production of the desired pelletized composition 960 in the manner described above in connection with FIGS. 1 and 2. To facilitate such transfer while maintaining the desired vacuum within vacuum region 515 and without necessity of interrupting the production process, such transfer is preferably carried out by way of an airlock 529. After being discharged from dryer 520 as indicated by reference 525 material being processed passes through airlock 529 prior to being transferred to pin mixer 90 as indicated by reference numeral 599. In some embodiments airlock 529 may suitably take the form of a rotary airlock feeder driven by a variable speed electric motor. By way of non-limiting example, some embodiments may use a commercially available type such as an HDX Series rotary airlock valve available from Wm. W. Meyer & Sons, Inc. of Libertyville, Ill. Use of a rotary airlock feeder allows material being processed to be fed though the airlock, either continuously and/or intermittently, without loss of vacuum within vacuum zone 515.

Another purpose served by the vacuum present in vacuum region 515 is to facilitate the capture of vapor which is liberated from the material being processed, either in dryer 520 and/or elsewhere within the vacuum region 515, for safe disposal and/or for recovery of useful substances from the vapor. Liberated vapor may be drawn from dryer 520 under vacuum by way of a flow path 547 into a condenser 550 which cools the vapor and condenses it to a liquid. In some embodiments the liquid may be transferred by way of a flow path 553 to a recovery tank 555, either for safe disposal and/or for recovery of useful liquid and/or substances present in the liquid. In certain embodiments, water, or any other suitable coolant is circulated through a cooling jacket of the condenser 550 and is recirculated between the condenser 550 and a cooling tower 562 by way of a pump 569 and flow paths 567, 568 and 560. Heat extraction from the cooling fluid may, in some embodiments, be enhanced by providing forced airflow over heat exchange surfaces of the cooling tower 562. In some embodiments, the condenser 550 may be of a conventional type such as one which includes one or more tubes having an interior passage through which the vapor and distilled liquid pass and an exterior wall which is in close thermal communication with the coolant passing through the cooling jacket. This arrangement allows heat transfer to take place through the walls of the tubes while maintaining a physical separation between the vapor and liquid which are present inside the tubes on one hand and the coolant which is located outside the tubes on the other hand.

After taking on heat as a result of passing through the cooling jacket of the condenser 550 the cooling fluid may be cooled in any suitable manner. In certain embodiments, a cooling tower 562 is provided for such purpose. The cooling tower 562 serves to remove heat from the coolant before it is returned to the cooling jacket of the condenser 550. In certain embodiments, the condenser 550 may be coupled to vacuum pump 523 by way of a condensate tank 560 by way of flow paths 557 and 524 as illustrated. In certain embodiments, condensate tank 560 and recovery tank 555 may suitably be different portions of a single tank. In such event, a bottom portion of the tank, where liquid distilled from the vapor is present, would serve as the recovery tank 555 and an upper portion of the tank, in which such liquid would not be present, would serve as condensate tank 560 and would be coupled to vacuum pump 523. In embodiments intended for recovery of polyethylene glycol, the temperature of the cooling fluid passing through the cooling jacket of condenser 550 is preferably maintained within a range of from about one hundred degrees Celsius to about one hundred fifty degrees Celsius (about 100° C. to about 150° C.).

Any vapors and/or gasses which may be discharged from the vacuum pump 523 may suitably be passed to a fan or other exhaust device 536 by way of a flow path 539. In embodiments in which the fluid heater 525 coupled to dryer 520 is of a type which is heated by combustion the exhaust device may suitably comprise a combustion air blower which may optionally be coupled to a combustion air intake of heater 527 by way of a closed flow path 535 in order to incinerate such vapors and/or gasses in lieu of exhausting them immediately to atmosphere.

Pelletized compositions were produced using the process described above resulting in pellets which were tested by measuring their size, binder content, shape (axial ratio), residual moisture content, and compressive strength. Residual moisture content consisted substantially entirely of bound water. For all the examples listed in Table 1 below, the raw waste material 5 used as a starting material was subjected to pre-processing 10 by drying to fifteen percent by weight (15 wt %) total moisture followed by screening to minus 16 mesh before being fed into pin mixer 90. For all the examples listed in Table 1 below, the solids portion of the raw waste material used as a starting material was comprised of 80 wt % Si, 15 wt % SiC and 5 wt % impurities which included Fe, C, Si, Al and $SiO_2$. No additives were added (e.g. from additives bin 100) at any point nor was any recycled pellet material used. In the pin mixer 90, calcium lignosulphonate diluted with water to a concentration of twenty five percent by weight (25 wt %) solids was sprayed into the mixture in an amount such that calcium lignosulphonate solids came to constitute about 2 wt % of the overall mixture the case of Examples 1, 2, 5, 6 and about one percent by weight (1 wt %) of the overall mixture in the case of Examples 3, 4, 7 and 8. After thorough mixing in the pin mixer 90, the mixture was transferred to a pelletizing disc 180. While the pelletizing disc 180 was operating, calcium lignosulphonate diluted with water to a concentration of twenty five percent by weight (25 wt %) solids was once again sprayed into the mixture in an amount such that calcium lignosulphonate solids came to constitute about four percent by weight (4 wt %) of the overall mixture in the case of Examples 1, 2, 5, 6 and about 2 wt % of the overall mixture in Examples 3, 4, 7 and 8. Pellet nucleation and growth proceeded in the pelletizing disc until pellets capable of passing through a screen of ⅝ths inch mesh and being captured by 40 mesh screen were formed. Pellets of a mesh size minus five eighths inch (−⅝th in.) by forty (40) mesh were transferred to an oil-fired fluidized bed dryer 270 operating at a combustion chamber air inlet temperature of five hundred degrees Fahrenheit (500° F.). Drying in fluidized bed dryer 270 was continued until the total moisture content of the pellets fell to or below 2 wt % whereupon the pellets were transferred to a fluidized bed dryer 270 in which they were cooled under forced air until their temperature was reduced to one hundred degrees Fahrenheit (100° F.). The cooled pellets were then subjected to classification by size using a dual screen vibratory screener 280 whose upper screen was one half inch (½ inch) mesh size and whose lower screen was sized at 36 mesh. Pellets sized minus one half inch by thirty six mesh (−½ inch by 36 mesh) were captured between the screens. The (−½ inch by 36 mesh) were classified into two batches. A first one of those batches was subjected to further vibratory screening to select pellets mesh sized minus one half inch by seven mesh (−½ in. by 7 mesh). A second one of the aforementioned batches was subjected to further vibratory screening to select pellets mesh sized minus seven mesh by thirty six mesh (−7 mesh by 36 mesh). Axial ratio refers to the ratio of the dimensions of a pellet taken along is longest axis to its maximum dimension as measured along an axis transverse to its longest axis and is an indicator of the shape of a pellet.

TABLE 1

| Pellet | Size | Binder Content (Solids) | Shape (Axial Ratio) | Moisture Content | Compressive Strength |
|---|---|---|---|---|---|
| Example 1 | −½ inch × 7 Mesh | 4 wt % | 1.2 × 1.0 | 2.0 wt % | 12 PSI |
| Example 2 | −½ inch × 7 Mesh | 4 wt % | 1.2 × 1.0 | 2.0 wt % | 12 PSI |
| Example 3 | −½" × 7 Mesh | 2 wt % | 1.3 × 1.0 | 1.5 wt % | 9 PSI |
| Example 4 | −½" × 7 Mesh | 2 wt % | 1.3 × 1.0 | 1.5 wt % | 9 PSI |
| Example 5 | −7 Mesh × 36 Mesh | 4 wt % | 1.2 × 1.0 | 1.5 wt % | 10 PSI |
| Example 6 | −7 Mesh × 36 Mesh | 4 wt % | 1.2 × 1.0 | 1.5 wt % | 10 PSI |
| Example 7 | −7 Mesh × 36 Mesh | 2 wt % | 1.3 × 1.0 | 1.0 wt % | 8 PSI |
| Example 8 | −7 Mesh × 36 Mesh | 2 wt % | 1.3 × 1.0 | 1.0 wt % | 8 PSI |

Table 2 below provides the results of testing of additional pelletized compositions produced according to the method of the present invention. The pellets of Examples 9 through 12 were produced in the same manner as those of Examples 1 through 8 above with two exceptions. Firstly, the solids portion of the raw waste material used as starting materials in the cases of Examples 9 through 12 were different. Secondly, the amounts of calcium lignosulphonate binder added in the pin mixer 90 and the pelletizing disc 180 were different. More particularly, the solids portion of the raw waste material used as starting materials in the cases of Examples 9 through 12 were as follows:

Examples 9 and 11: 15 wt % Si, 80 wt % SiC and 5 wt % impurities which included Fe, C, Si, Al and $SiO_2$.

Examples 10 and 12: 80 wt % Si, 15 wt % SiC and 5 wt % impurities which included Fe, C, Si, Al and $SiO_2$.

In Examples 9 through 12 of Table 2, calcium lignosulphonate diluted with water to a concentration of twenty five percent by weight (25 wt %) solids was sprayed into the mix in the pin mixer an amount such that calcium lignosulphonate solids came to constitute about one point five percent by weight (1.5 wt %) of the overall mix present in pin mixer 90. After the mixture entered the pelletizing disc 180 calcium lignosulphonate diluted with water to a concentration of 25 wt % solids was sprayed into the mixture in the pelletizing disc 180 in a like amount as had been added in the pin mixer 90 such that calcium lignosulphonate solids came to constitute about three point zero percent by weight (3.0 wt %) of the overall mixture present in the pelletizing disc 180 after the addition of calcium lignosulphonate.

TABLE 2

| Pellet | Size | Binder Content (solids)/ Moisture Content (wt %) | Si/SiC Ratio in Pellet (wt %) | Compressive Strength (PSI) |
|---|---|---|---|---|
| Example 9 | −½ inch × 7 Mesh | 3.0/1.5 | 15:80 | 12 |
| Example 10 | −½ inch × 7 Mesh | 3.0/1.5 | 80:15 | 12 |
| Example 11 | −7 Mesh × 36 Mesh | 3.0/1.5 | 15:80 | 10 |
| Example 12 | −7 Mesh × 36 Mesh | 3.0/1.5 | 80:15 | 10 |

What is claimed is:

1. A method of making a pelletized composition, said method comprising the steps of:

(a) providing a material containing moisture and at least: (i) silicon carbide or (ii) both silicon carbide and silicon;

(b) heating said material under a vacuum to dry said material to a total moisture content of less than fifteen percent by weight;

(c) mixing said material with a binder to form a mixture;

(d) pelletizing said mixture to agglomerate said particles to form a plurality of discrete pellets of at least one desired size, each of said pellets including a plurality of said particles, and (e) hardening said binder to strengthen said pellets.

2. A method according to claim 1 further comprising the step of heating said pellets to reduce said moisture present in said pellets to less than or equal to two percent by weight.

3. A method according to claim 2 wherein said binder comprises a thermoset binder and at least a portion of said step of hardening said binder is carried out during said step of heating said pellets to reduce said moisture present in said pellets to less than or equal to two percent by weight.

4. A method according to claim 1 or claim 2 or claim 3 wherein said material comprises, by weight percentage of total solids, any combination or subcombination of the following which totals one hundred percent by weight:

twenty percent by weight to eighty percent by weight silicon carbide;

zero percent by weight to fifty percent by weight silicon;

less than five percent by weight carbon;

less than ten percent by weight iron, and less than one percent by weight of other impurities.

5. A method according to claim 1 wherein said binder comprises calcium lignosulfonate present in an amount effective to provide said pellets with a compression strength of at least eight pounds per square inch after said hardening step has been carried out.

6. A method of making a pelletized composition, said method comprising the steps of:

(a) providing a material containing moisture and which includes at least silicon carbide and moisture, said moisture including at least one organic;

(b) heating said material under a vacuum to dry said material to a total moisture content of less than fifteen percent by weight, said vacuum being sufficient to lower a boiling point of said organic below a decomposition temperature of said organic, said heating being carried out at a temperature which exceeds said boiling point of said organic under said vacuum but does not exceed said decomposition temperature of said organic, (c) mixing said material with a binder to form a mixture;

(d) pelletizing said mixture to agglomerate said particles to form a plurality of discrete pellets of at least one desired size, each of said pellets including a plurality of said particles, and (e) hardening said binder to strengthen said pellets.

7. A method according to claim 6 further comprising the steps of capturing vapor liberated from said material as a result of said heating step and condensing said vapor to a liquid.

8. A method according to claim 7 further comprising the step of heating said pellets after said pelletizing step to reduce said moisture present in said pellets to less than or equal to two percent by weight.

9. A method according to claim 6 or 7 further comprising the step of removing at least some of said moisture from said material prior to carrying out said heating step.

* * * * *